United States Patent [19]

Fujimoto et al.

[11] Patent Number: 4,965,175

[45] Date of Patent: Oct. 23, 1990

[54] METHOD FOR PROCESSING A SILVER HALIDE PHOTOSENSITIVE MATERIAL FOR COLOR PHOTOGRAPHY

[75] Inventors: Hiroshi Fujimoto; Kazuaki Yoshida, both of Kanagawa, Japan

[73] Assignee: Fuji Photo Film Co., Ltd., Kanagawa, Japan

[21] Appl. No.: 416,556

[22] Filed: Oct. 3, 1989

[30] Foreign Application Priority Data

Oct. 3, 1988 [JP] Japan ..... 63-249236

[51] Int. Cl.[5] ..... G03C 7/30

[52] U.S. Cl. ..... 430/375; 430/376; 430/467; 430/470; 430/484; 430/486; 430/489; 430/490; 430/963

[58] Field of Search ..... 430/375, 376, 467, 470, 430/486, 489, 490, 963

[56] References Cited

U.S. PATENT DOCUMENTS 4,066,457 1/1978 Panasik et al. ..... 430/484
4,481,268 11/1984 Bailey et al. ..... 430/484
4,756,997 7/1988 Marchesano ..... 430/484
4,801,521 1/1989 Ohki et al. ..... 430/490
4,892,804 1/1990 Vincent et al. ..... 430/464

*Primary Examiner*—Paul R. Michl
*Assistant Examiner*—Hoa V. Le
*Attorney, Agent, or Firm*—Sughrue, Mion, Zinn, Macpeak & Seas

[57] ABSTRACT

A method for continuous processing of a silver halide color photosensitive material is disclosed. The process steps comprise developing a color photographic light-sensitive material comprising a support having thereon at least one light-sensitive silver halide emulsion layer containing a silver halide comprising at least 80 mol % silver chloride, in a color developer solution containing a chloride ion concentration of from $3.5\times10^{-2}$ to $2.0\times10^{-1}$ mol/1, said developing step being conducted in a developer bath having a bath opening ratio (S/V) of at most 0.015 $cm^{-1}$ wherein S is air-contacting area of the bath in $cm^2$ and V is a total volume of the bath in $cm^3$.

13 Claims, No Drawings

METHOD FOR PROCESSING A SILVER HALIDE PHOTOSENSITIVE MATERIAL FOR COLOR PHOTOGRAPHY

FIELD OF THE INVENTION

The present invention relates to a method for processing a silver halide photosensitive material for color photography, and more particularly to a method for rapid development of a high silver chloride (chloride-rich) silver halide photosensitive material for color photography by continuous processing, with minimal variations in photographic characteristics.

BACKGROUND OF THE INVENTION

In the photographic processing of photosensitive materials for color photography, the recent demand for quick print delivery and reduced commercial laboratory work load has made it necessary to reduce the photographic processing time. While the commonest approach to shortening of processing time is to increase the processing temperature and/or the replenishment rate, many other procedures such as intensified agitation, addition of accelerators, have been proposed.

Particularly, for insuring rapid color development and/or reducing the replenishment rate, the use of a color photosensitive material employing a silver chloride emulsion in lieu of the conventional silver bromide and silver iodide emulsions has been proposed. By way of example, PCT WO 87-04534 discloses a rapid processing technique in which a chloride-rich silver halide color photosensitive material is treated with a color developer which is substantially free from sulfite ions and benzyl alcohol. However, this method is disadvantageous in that continuous processing tends to result in variations in photographic characteristics, particularly in sensitivity and gradation, according to changes in processing load. Furthermore, if the developer replenishment rate is decreased, the chloride ion level in the developer is progressively increased to interfere with maintenance of the photographic characteristics of the chloride-rich silver halide photosensitive material.

Rapid processing methods using such chloride-rich silver halide color photosensitive materials are described in PCT WO 87-04534 and JP-A-58-75345, JP-A-59-232341 and JP-A-61-70552 (the term "JP-A" herein used means "unexamined Japanese patent publication"). In these processes wherein photographic processing is performed at a chloride ion concentration not exceeding $3.0\times10^{-2}$ moles/l and at the recommended developer replenishment rate, stable rapid processing can be accomplished when the processing load is sufficiently high. However, it has been found that if the developer replenishment rate is reduced or if, when the processing load is small, the chloride ion concentration of the developer is increased to inhibit an increase in fog, the variation in photographic characteristics due to changes in the concentrations of other processing chemicals will be markedly increased.

SUMMARY OF THE INVENTION

An object of this invention is to provide a photographic developing method for a chloride-rich silver halide color photosensitive material, that provides rapid development and stable photographic characteristics with minimal variations in sensitivity and gradation which are otherwise inevitable in continuous processing.

It has now been found that this and other objects of present invention are attained by a method for continuous processing of a silver halide color photosensitive material is which comprises developing a color photographic light-sensitive material comprising a support having thereon at least one light-sensitive silver halide emulsion layer containing a silver halide comprising at least 80 mol % silver chloride, in a color developer solution containing a chloride ion concentration of from $3.5\times10^{-2}$ to $2.0\times10^{-1}$ mol/l, said developing step being conducted in a developer bath having a bath opening ratio (S/V) of at most 0.015 $cm^{-1}$ wherein S is air-contacting area of the bath in $cm^2$ and V is a total volume of the bath in $cm^3$.

DETAILED DESCRIPTION OF THE INVENTION

According to a continuous processing a silver halide color photosensitive material in a color developing machine, a color developing agent is consumed to thereby lower a pH of the solution, whereas a halide ion is eluted into the solution from the photosensitive material, the developing solution should be replenished to recover the property. Generally, a color developing replenisher is supplied during processing operation so as to maintain a balance of these components in the developing solution. Thus, the continuous development may be accomplished to obtain a stable photographic property of the developed image. After an intensive study, the inventors of the present invention have found that other processing chemicals, particularly the preservative for the color developing agent, as well as a change in pH, are of great importance in maintaining stable automatic, rapid processing. For controlling variations in photographic characteristics, it is effective to reduce the bath opening ratio for the color developer bath in the automatic development system. The improvement in the variation of photographic characteristics is remarkably enhanced when the bath opening ratio is not more than 0.015 $cm^{-1}$. Without being bound by theory in any way, it is considered likely that this is due to a balance in the degradation of the preservative for the color developing agent, between the oxidative decomposition by oxygen which is associated with the bath opening ratio and the thermal decomposition of the bath which is not associated with the bath opening ratio.

It has been found that the use of a compound represented by formula (I) described below as a preservative for the color developer results in a marked improvement in preservative effect as compared with the use of a conventional hydroxylamine or the like when the bath opening ratio is reduced with the processing temperature held constant.

The term "bath opening ratio" as used herein is defined as follows:

$$\frac{\text{Air-contacting area of the bath (cm}^2\text{)}}{\text{Total volume of the bath (cm}^3\text{)}} = \frac{S}{V}$$

The bath opening ratio can generally be reduced by using a floating lid of synthetic resin which is adapted to block the passage of air or by using a slit developing apparatus as described for example in Japanese Patent Application No. 61-278283, 62-50949 and 62-70006.

The color developer to be used in the present invention is described hereinafter.

The following relationship between V and S is preferred:

$S/V \leqq 0.05$, preferably $S/V \leqq 0.01$The smaller the S/V value, the smaller is the degree of atmospheric oxidation and the lower is the evaporation rate, that is to say the longer is the bath maintained in stable condition in the vessel. For practical purposes, however, the lower limit of S/V is 0.0005 and preferably 0.001.

In the conventional process, "S" takes 1.5 to $7\times10^4$ $cm^2$, preferably 7.5 to $3\times10^4$ $cm^2$, particularly 75 to 500 $cm^2$ for a automatic developing machine in small scale laboratory, and $1\times10^4$ to $5\times10^4$ $cm^2$ in large scale laboratory.

As for "V", in the conventional process, "V" takes $1\times10^{-1}$ to $5\times10^3$ l, preferably $5\times10^{-1}$ to $3\times10^3$ l, and more preferably $5\times10^{-1}$ to $6\times10^2$ l, particularly 5 to 30 l in small scale laboratory, and $3\times10^2$ to $5\times10^3$ l in large scale laboratory.

In accordance with this invention, the color developer should contain $3.5\times10^{-2}$ to $2.0\times10^{-1}$ moles/l, preferably $4.0\times10^{-2}$ to $1.5\times10^{-1}$ moles/l, of chloride ion. When the chloride ion concentration is less than $3.5\times10^{-2}$ moles/l, the photographic characteristics are somewhat improved by decreasing the bath opening ratio but there is no range of bath opening ratio that significantly improves in photographic characteristics. When the chloride ion concentration is over $2.0\times10^{-1}$ moles/l, the disadvantage of retarded development reduces the benefit of the present invention. The chloride ion may be either directly added to the color developer or released from the photosensitive material in the course of development. When chloride ions are directly added to the color developer, the chloride ion donor substance that can be used for this purpose include, e.g., sodium chloride, potassium chloride, ammonium chloride, nickel chloride, magnesium chloride, manganese chloride, calcium chloride, cadmium chloride or the like. Preferred donors are sodium chloride and potassium chloride. When the chloride ion is released from the photosensitive material during development, it may be supplied from the silver chloride emulsion or from the fluorescent brightener.

In the color developer, it is preferred to incorporate a compound of formula(I):

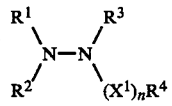

wherein $R^1$, $R^2$ and $R^3$, which may be the same or different, each represents hydrogen, a $C_{1-20}$ alkyl group, a $C_{6-20}$ aryl group or a $C_{1-20}$ heterocyclic group; $R^4$ represents hydrogen, a hydroxyl group, a hydrazino group, a $C_{1-20}$ alkyl group, a $C_{6-20}$ aryl group, a $C_{1-20}$ heterocyclic group, a $C_{1-20}$ alkoxy group, a $C_{6-20}$ aryloxy group, a $C_{1-20}$ carbamoyl group or a $C_{0-20}$ amino group; $X^1$ represents a divalent linking group; and n is 0 or 1; provided that when n is 0, $R^4$ represents a $C_{1-20}$ alkyl group, a $C_{6-20}$ aryl group or a $C_{1-20}$ heterocyclic group; and $R^3$ and $R^4$ may be linked to form a heterocyclic group.

The compounds of formula (I), i.e., hydrazine analogs including hydrazines and hydrazides, which are used in the present invention are described in further detail below.

$R^1$, $R^2$ and $R^3$ each represents hydrogen, a substituted or unsubstituted alkyl group (preferably alkyl groups containing 1 to 20 carbon atoms such as methyl, ethyl, sulfopropyl, carboxybutyl, hydroxyethyl, cyclohexyl, benzyl and phenethyl), substituted or unsubstituted aryl groups (preferably aryl groups containing 6 to 20 carbon atoms, such as phenyl, 2,5-dimethoxyphenyl, 4-hydroxyphenyl, and 2-carboxyphenyl) or a substituted or unsubstituted heterocyclic group (preferably $C_{1-20}$, 5- to 6-membered heterocyclic groups containing at least one hetero atom such as oxygen, nitrogen and sulfur, such as pyridin-4-yl, and N-acetylpiperidin-4-yl).

$R^4$ represents hydrogen, a hydroxyl group, a substituted or unsubstituted hydrazino group (such as hydrazino, methylhydrazino, or phenylhydrazino), a substituted or unsubstituted alkyl group (preferably $C_{1-20}$ alkyl groups such as methyl, ethyl, sulfopropyl, carboxybutyl, hydroxyethyl, cyclohexyl, benzyl, t-butyl, or n-octyl), a substituted or unsubstituted aryl group (preferably $C_{6-20}$ aryl groups such as phenyl, 2,5-dimethoxyphenyl, 4-hydroxyphenyl, 2-carboxyphenyl, or 4-sulfophenyl), a substituted or unsubstituted heterocyclic group (preferably $C_{1-20}$, 5- or 6-membered helerocyclic groups containing at least one hetero atom such as oxygen, nitrogen or sulfur, such as pyridin-4-yl, or imidazolyl), a substituted or unsubstituted alkoxy group (preferably $C_{1-20}$ alkoxy groups such as methoxy, ethoxy, methoxyethoxy, benzyloxy, cyclohexyloxy, octyloxy), a substituted or unsubstituted aryloxy group (preferably $C_{6-20}$ aryloxy groups such as phenoxy, p-methoxyphenoxy, p-carboxyphenyl, or p-sulfophenoxy), a substituted or unsubstituted carbamoyl group (preferably $C_{1-20}$ carbamoyl groups such as carbamoyl, N,N-diethylcarbamoyl, or phenylcarbamoyl), or a substituted or unsubstituted amino group (preferably $C_{0-20}$ amino groups such as amino, hydroxyamino, methylamino, hexylamino, methoxyethylamino, carboxyethylamino, sulfoethylamino, N-phenylamino, or p-sulfophenylamino).

Further substituents for $R^1$, $R^2$, $R^3$ and $R^4$ preferably include halogens (chlorine, bromine), hydroxyl, carboxyl, sulfo, amino, alkoxy, amido, sulfonamido, carbamoyl, sulfamoyl, alkyl, aryl, aryloxy, alkylthio, arylthio, nitro, cyano, sulfonyl, and sulfinyl groups, and these substituent groups may be further substituted.

$X^1$ is preferably a divalent organic group, including —CO—, —$SO_2$—or

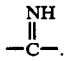

In formula (I), n is either 0 or 1, and when n is 0, $R^4$ represents a substituted or unsubstituted alkyl, aryl or heterocyclic groups. $R^1$ and $R^2$ or $R^3$ and $R^4$ may be linked form a heterocycle.

When n is 0, at least one of $R^1$ through $R^4$ is preferably a substituted or unsubstituted alkyl group. Particularly preferably, $R^1$, $R^2$, $R^3$ and $R^4$ each represents hydrogen or a substituted or unsubstituted alkyl group, provided that at least one of $R^1$, $R^2$, $R^3$ and $R^4$ represents an alkyl group. Especially preferably, $R^1$, $R^2$ and $R^3$ each represents hydrogen and $R^4$ represents a substituted or unsubstituted alkyl group; $R^1$ and $R^3$ each represents hydrogen and $R^2$ and $R^4$ each represents a substituted or unsubstituted alkyl group; or $R^1$ and $R^2$ each represents hydrogen and $R^3$ and $R^4$ each represents a substituted or unsubstituted alkyl group (in which case $R^3$ and $R^4$ may be linked to form a heterocycle).

When n is 1, $X^1$ preferably represents —CO—; $R^4$ preferably represents a substituted or unsubstituted amino group; and $R^1$ through $R^3$ each preferably represents hydrogen or a substituted or unsubstituted alkyl group.

In formula (I), n preferably is 0.

The alkyl groups $R^1$ through $R^4$ preferably contain 1 to 10 carbon atoms and more desirably 1 to 7 carbon atoms. Preferred substituents for these alkyl groups, include hydroxyl, carboxyl, sulfo and phosphono groups. When there are two or more substituents, they may be the same or different.

The compound of general formula (I) may be a bis or tris compound or a polymer formed through $R^1$, $R^2$, $R^3$ and $R^4$.

Examples of specific compounds represented by formula (I) are as follows, but the present invention is not to be construed as being limited thereto:

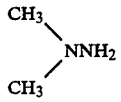
(I-1)

$CH_3NHNHCH_3$ (I-2)

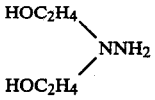
(I-3)

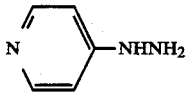
(I-4)

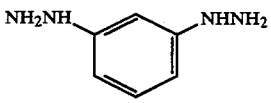
(I-5)

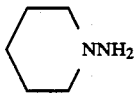
(I-6)

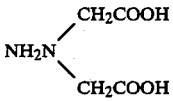
(I-7)

$HOOCCH_2NHNHCH_2COOH$ (I-8)

$NH_2NH\text{-}(CH_2)_3\text{-}NHNH_2$ (I-9)

$NH_2NHCH_2CH_2OH$ (I-10)

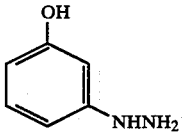
(I-11)

$NH_2NH\text{—}(CH_2)_3\text{—}SO_3H$ (I-12)

$NH_2NH\text{—}(CH_2)_4\text{—}SO_3H$ (I-13)

$NH_2NH\text{—}(CH_2)_3\text{—}COOH$ (I-14)

-continued

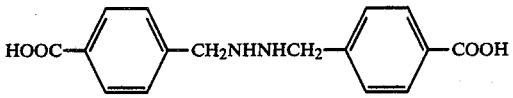
(I-15)

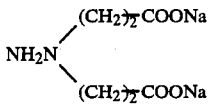
(I-16)

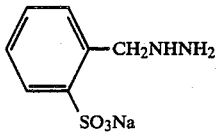
(I-17)

$NaOOCCH(CH_3)NHNHCH(CH_3)COONa$ (I-18)

$NH_2NHCH_2CH_2COONa$ (I-19)

$NH_2NHCH_2COONa$ (I-20)

$H_2NNHCH_2CH_2SO_3Na$ (I-21)

$H_2NNHCH(C_4H_9(n))COOH$ (I-22)

$H_2NNHCH(C_6H_{13}(n))COOH$ (I-23)

$H_2NN(CH(C_4H_9(n))COOH)_2$ (I-24)

$H_2NN(CH_2CH_2SO_3Na)_2$ (I-25)

$H_2NN(CH_2CH_2CH_2SO_3Na)_2$ (I-26)

$H_2NN(CH(C_2H_5)COOH)_2$ (I-27)

$H_2NNHCH(CH_3)COOH$ (I-28)

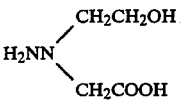
(I-29)

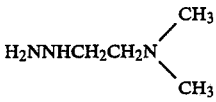
(I-30)

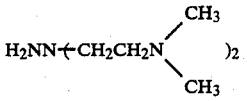
(I-31)

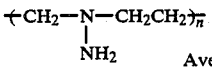
(I-32)

Average molecular weight: ca 4,000

-continued
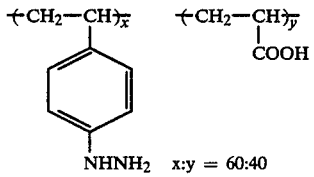
x:y = 60:40
Average molecular weight: ca 20,000 (I-33)
$NH_2NHCONH_2$ (I-34)
$NH_2NHC(=NH)NH_2$ (I-35)
$NH_2NHCONHNH_2$ (I-36)
$NH_2NHSO_3H$ (I-37)
$NH_2NHSO_2NHNH_2$ (I-38)
$CH_3NHNHSO_2NHNHCH_3$ (I-39)
$NH_2NHCONH-(CH_2)_3-NHCONHNH_2$ (I-40)
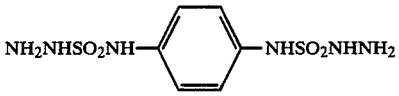
(I-41)
$NH_2NHCOCONHNH_2$ (I-42)
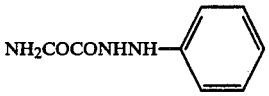
(I-43)
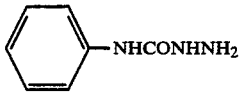
(I-44)
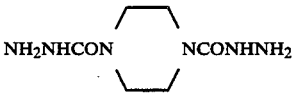
(I-45)
$NH_2COCONHNH_2$ (I-46)
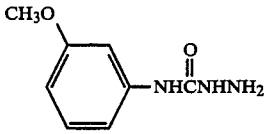
(I-47)
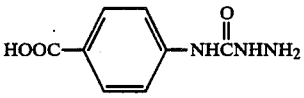
(I-48)
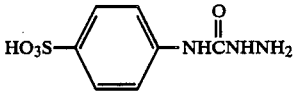
(I-49)
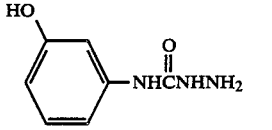
(I-50)
-continued
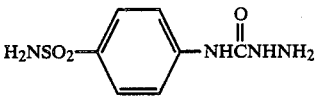
(I-51)
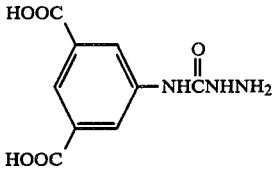
(I-52)
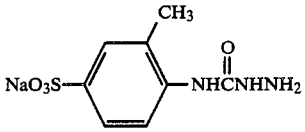
(I-53)
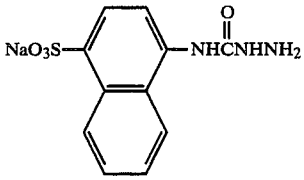
(I-54)
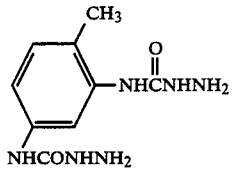
(I-55)
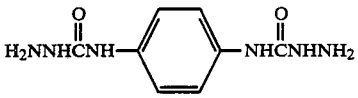
(I-56)
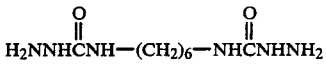
(I-57)
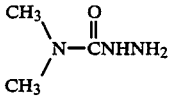
(I-58)
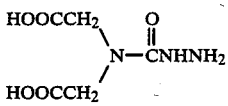
(I-59)
$NaO_3SCH_2CH_2NHC(=O)NHNH_2$ (I-60)
$HOOCCH_2CH_2NHC(=O)NHNH_2$ (I-61)
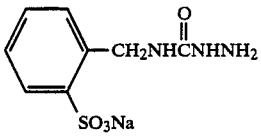
(I-62)
$NH_2NHCOOC_2H_5$ (I-63)
$NH_2NHCOCH_3$ (I-64)

-continued (I-65)

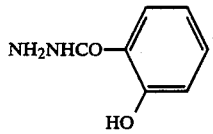

(I-66)

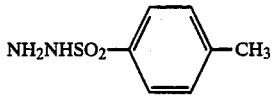

$NHNHCH_2PO_3H_2$ (I-67)

(I-68)

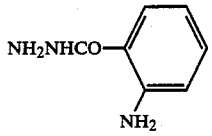

(I-69)

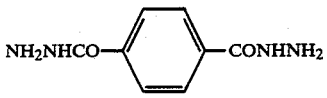

(I-70)

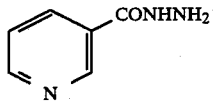

(I-71)

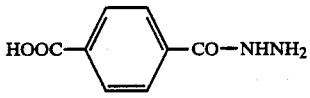

(I-72)

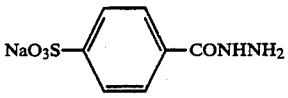

$(CH_3)_3CCONHNH_2$ (I-73)

(I-74)

$(CH_3)_3CC(=O)NHNH_2$ (I-75)

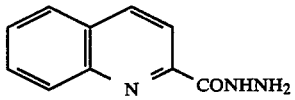

(I-76)

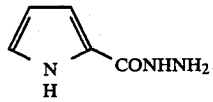

(I-77)

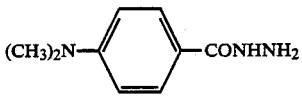

(I-78)

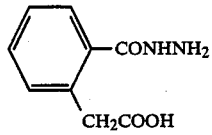

-continued (I-79)

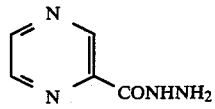

$HOCH_2CH_2SO_2NHNH_2$ (I-80)

$NaO_3SCH_2CH_2CONHNH_2$ (I-81)

$H_2NCONHCH_2CH_2SO_2NHNH_2$ (I-82)

(I-83)

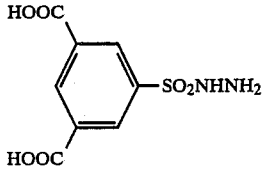

(I-84)

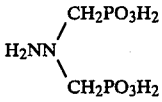

$H_2NNHCH_2CH_2PO_3H_2$ (I-85)

(I-86)

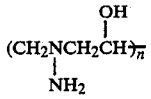

mol. wt 10 to 1000

Further specific examples of compound (I) other than those listed above, include the compounds described in JP-A-No.61-170756 at pages 11 to 24, JP-A-61-171682 at pages 12 to 22, and JP-A-No. 61-173468 at pages 9 to 19.

Many of the compounds of formula (I) are readily available from commercial sources, or can be synthesized by the general synthetic processes described, for example, in *Organic Syntheses,* Coll. vol. 2, pp. 208 to 213; *Amer. Chem. Soc.,* 36, 1747 (1914); *Yu Kagaku,* 24, 31 (1975); *Org. Chem.,* 25, 44 (1960); *Journal of the Pharmaceutical Society of Japan,* 91, 1127 (1971); *Organic Syntheses,* Coll. Vol. 1, p. 450; [*New Experimental Chemistry Series*], Vol. 14, III, P. 1621 to 1628 (Maruzen); *Beil.,* 2, 559; *Beil.,* 3, 117; E. P. Mohr et al., *Inorg. Syn.,* 4, 32 (1953); F. J. Wilson, E. C. Pickering, *J. Chem. Soc.,* 123, 394 (1923); N. J. Leonard, J. H. Boyer, *J. Org. Chem.,* 15, 42 (1950); *Organic Syntheses,* Coll. Vol. 5, p. 1055; P. A. S. Smith, *Derivatives of hydrazine and other hydronitrogens having n-n-bonds,* p. 120 to 124, p. 130 to 131 (Benjamin/Cummings 1983); and Stanley R Sandier Waif Karo., *Organic Functional Group Preparations,* Vol. 1, Second Edition, p. 457.

The amount of compound (I) is preferably 0.1 to 50 g and more desirably 0.2 to 20 g per liter of the color developer.

The color developer according to this invention may contain the following organic preservatives, in addition to the compound of formula (I), in place of hydroxylamine and sulfite ions which are commonly used as preservatives for the developing agent.

The term "organic preservative" means any and all organic compounds which, when added to a processing solution for color photographic light-sensitive materials, would reduce the rate of degradation of the aromatic primary amine color developing agent. Thus, an organic preservative is an organic compound which has the property to inhibit atmospheric or other oxidation of color developing agents. Particularly useful organic preservatives are hydroxylamine derivatives (exclusive of hydroxylamine), hydroxamic acid compounds, phenols, α-hydroxyketones, α-aminoketones, saccharides, monoamines, diamines, polyamines, quaternary ammonium salts, nitroxy radicals, alcohols, oximes, diamide compounds, and condensed cyclic amines. These compounds are disclosed in JP-A-63-4235, JP-A-63-30845, JP-A-63-21647, JP-A-63-44655, JP-A-63-53511, JP-A-63-43140, JP-A-63-56654, JP-A-63-58349, JP-A-63-43138, JP-A-63-146041, JP-A-63-170642, JP-A-63-44657 and JP-A-63-44656, U.S. Pat. Nos. 3,615,503 and 2,494,903, JP-A-52-143020, JP-B-48-30496 and so on.

The color developer used in the present invention contains a conventional aromatic primary amine color developing agent. p-Phenylenediamines are preferred, including the following specific examples, but the present invention is not to be construed as being limited thereto:

D-1: N,N-Diethyl-p-phenylenediamine

D-2: 4-[N-Ethyl-N-(β-hydroxyethyl)amino]aniline

D-3: 2-Methyl-4-[N-ethyl-N-(β-hydroxyethyl)amino]-aniline

D-4: 4-Amino-3-methyl-N-ethyl-N-(β-methanesulfonamidoethyl)aniline

These p-phenylenediamine derivatives may be used as the corresponding sulfates, hydrochlorides, p-toluenesulfonates and other salts. The amount of aromatic primary amine developing agent is preferably about 0.1 to 20 g and more desirably about 0.5 to 10 g per liter of the developer.

The pH of the color developer to be used in accordance with the present invention is preferably 9 to 12 and more desirably 9 to 11.0, and this color developer may further contain other known developing agents.

The above-mentioned pH is preferably established with buffers. Among the buffers useful for this purpose are sodium carbonate, potassium carbonate, sodium hydrogen carbonate, potassium hydrogen carbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The amount of the above buffer or buffers added to the color developer is preferably not less than 0.1 mole/l and more desirably in the range of 0.1 to 0.4 mole/l.

In addition, the color developer may contain various chelating compounds for preventing precipitation of calcium and magnesium or improving the stability of the solution. The following specific compounds, may be used, but the present invention is not to be construed as being limited thereto.

Nitrilotriacetic acid
Diethylenetriaminepentaacetic acid
Ethylenediaminetetraacetic acid
Triethylenetetraminehexaacetic acid
N,N,N-trimethylenesulfonic acid
Ethylenediamine-N,N,N',N'-tetramethylenesulfonic acid
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether-diaminetetraacetic acid
Hydroxyethylenediaminetriacetic acid
Ethylenediamine-o-hydroxyphenylacetic acid
2-Phosphonobutane-1,2,4-tricarboxylic acid
N,N'-bis(2-Hydroxybenzyl)ethylenediamine-N,N'-diacetic acid These chelating agents may be used in combination as necessary.

The amount of such chelating agent or agents added should only be sufficient to block the metallic ions in the color developer. For example, a suitable concentration is about 0.1 to 10 g per liter.

If necessary, an optional development accelerator can be incorporated in the color developer, including the thioether compounds described in JP-B-37-16088, JP-A-37-5987, JP-A-38-7826, JP-A-45-12380, JP-A-45-9019 and U.S. Pat. No. 3,813,247; the p-phenylenediamine compounds described in JP-A-52-49829 and JP-A-50-15554; the quaternary ammonium salts described in JP-A-50-137726, JP-B-44-30074, JP-A-56-156826 and JP-A-52-43429; the p-aminophenol compounds described in U.S. Pat. Nos. 2,610,122 and 4,119,462; the amine compounds described in U.S. Pat. Nos. 2,494,903, 3,128,182, 4,230,796, 3,253,919, JP-B-41-11431, U.S. Pat. Nos. 2,482,546, 2,596,926 and 3,582,346; the polyalkylene oxides described in JP-B-47-16088 and JP-B-42-25201, U.S. Pat. No. 3,128,183, JP-B-40-11431 and JP-B-42-23883 and U.S. Pat. No. 3,532,501; 1-phenyl-3-pyrazolidone compounds, hydrazines, meso-ionic compounds, ionic compounds, and imidazoles.

In the present invention, an appropriate antifoggant can be added as necessary. As the antifoggant, alkali metal halides such as potassium bromide and potassium iodide and various organic antifoggants can be employed. Representative organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The color developer used in the present invention preferably contains a fluorescent brightener. Preferred examples of fluorescent brighteners include 4,4'-diamino-2,2'-disulfostilbene compounds. The level of addition of the brightener ranges from 0 to 5 g and preferably from 0.1 to 4 g/l.

If necessary, various surfactants such as alkylsulfonic acids, arylsulfonic acids, aliphatic carboxylic acids, and aromatic carboxylic acids may be incorporated.

The processing temperature of the color developer according to the present invention is 20° to 50° C. and preferably 30° to 40° C. The development processing time is 20 seconds to 5 minutes and preferably 30 seconds to 2 minutes.

The photographic emulsion layer after color development is generally bleached. The bleaching may be performed simultaneously with fixation (bleach-fix) or independently. For rapid photographic processing, the sequence of bleach and bleach-fix may be adopted. As further alternatives, the use of serial two-bath bleach-fix, fix and bleach-fix sequence, or bleach-fix and bleach sequence may be adopted. Examples of the bleaching agent include compounds of polyvalent metals such as iron (III), cobalt (III), chromium (VI) and copper (II), peracids, quinones, and nitro compounds. Representative examples of the bleaching agent, include ferricyanides, dichromates, organic complex salts of iron (III) or cobalt (III), such as the corresponding complexes with aminopolycarboxylic acids such as ethylenediaminetetraacetic acid, diethylenetriaminepentaacetic acid, cyclohexanediaminetetraacetic acid, methyliminodiacetic acid, 1,3-diaminopropanetetraacetic acid, glycol ether-diaminetetraacetic acid; citric acid, tartaric acid, malic acid, persulfates, hydrobromides, permanganates, and nitrobenzene compounds. Among these compounds, aminopolycarboxylic acid-iron (III) complexes represented by the ethylenediaminetetraacetic acid-iron (III) complex and persulfates are preferred from the standpoint of rapid processing and prevention of environmental pollution. Furthermore, aminopolycarboxylic acid-iron (III) complexes are especially suitable for use in bleach or bleach-fix baths. The pH of the bleach or bleach-fix bath incorporating such an aminopolycarboxylic acid-iron (III) complex is generally pH 5.5 to 8. For more rapid processing, however, a lower pH may be adopted.

In the bleach bath, bleach-fix bath and the respective pre-baths, a bleach accelerator may be incorporated if necessary. Specific useful examples of the bleach accelerator are described in the following publications. Mercapto and disulfide compounds are described in U.S. Pat. No. 3,893,858, West German Patent No. 1,290,812, JP-A-No. 53-95630, and *Research Disclosure* No. 17129 (July, 1978), thiazolidine compounds are described in JP-A-50-140129; thiourea derivatives are described in U.S. Pat. No. 3,706,561; iodides are described in JP-A-58-16235; polyoxyethylene compounds are described in West German Patent No. 2,748,430; polyamine compounds are described in JP-B-45-8836; bromide ion. Particularly preferred from the standpoint of acceleration effects are mercapto or disulfide compounds, and the compounds mentioned in U.S. Pat. No. 3,893,858, West German Patent No. 1,290,812 and JP-A-53-95630 are especially useful. The compounds mentioned in U.S. Pat. No. 4,552,834 are also preferred. Such a bleach accelerator can be incorporated in the photosensitive material. The bleach accelerator is particularly effective in the bleach-fixing of color photographic photosensitive materials.

Examples of the fixing agent include thiosulfates, thiocyanates, thioethers, thiourea compounds, and iodides which are used in large amounts. Generally, however, thiosulfates, particularly ammonium thiosulfate, are versatile. As preferred preservatives for the bleach-fix bath, there may be mentioned sulfites, bisulfites, sulfinic acid compounds and carbonylbisulfite adducts.

The silver halide color photosensitive material of the present invention is generally subjected to a processing sequence of fixation (removal of silver salts) and washing and/or stabilization. The quantity of water to be used in the washing stage is dependent on, and can be selected liberally according to the characteristics of the photosensitive material (including the coupler and other components, for instance), intended use, washing water temperature, number of washing tanks (stages), replenishing system (countercurrent or cocurrent) and other conditions. Particularly, the relation between the number of washing tanks and the quantity of water in the multi-stage counter-current system can be determined by the method described in *Journal of the Society of Motion Picture and Television Engineers* 64, p. 248 to 253, May, 1955.

The use of the multi-stage counter-current system disclosed in the above-mentioned literature significantly reduces the required quantity of washing water but, because of an increased residence time of water in the tanks, favors the growth of bacteria, resulting in suspended matter being deposited on the photosensitive material. To overcome this disadvantage in the processing of the photosensitive material of this invention, the procedure for reducing the amount of calcium and magnesium ions as described in Japanese Patent Application No. 61-131632 can be used. Furthermore, it is possible to employ a bactericide such as the isothiazolone compounds described in JP-A-57-8542 and the thiabendazole compounds, chloride-containing bactericides such as chlorinated sodium isocyanurate, benzotriazole and other bactericides described in Hiroshi Hori: *Chemistry of Antibacterial and Antifungal Agents,* Hygienic Technology Association (ed.): *Sterilization and Disinfection,* and The Research Society of Antibacterial and Antifungal Agents, Japan: *Encyclopedia of Antibacterial and Antifungal Agents.*

The pH of the washing water to be used in the processing of the photosensitive material of the invention is from 4 to 9 and is preferably 5 to 8. While the washing water temperature and the washing time can also be liberally selected according to the characteristics and intended use of the photosensitive material, these conditions are generally 15° to 45° C. and 20 sec. to 10 min., and preferably 25° to 40° C. and 30 sec. to 5 min. Furthermore, the photosensitive material according to the present invention can be directly processed with a stabilization bath in lieu of the above-mentioned washing bath. In such a stabilization process, any of the known procedures described in JP-A-57-8543, JP-A-58-14834 and JP-A-60-220345 can be utilized.

Downstream from the above-mentioned washing stages, a stabilization stage is sometimes provided and, as an example, a stabilizing bath containing formalin and a surfactant which is used as a final bath for the photographic color light-sensitive material can be mentioned. This stabilizing bath may also contain various chelating agents and antimicrobial agents.

The overflow liquids associated with washing and/or stabilizing bath replenishing can be reused in other processes such as desilvering.

For the purposes of simplifying and expediting the processing procedures, the silver halide color photosensitive material according to the invention may contain a color developing agent. For incorporation of a color developing agent, the use of a developing agent precursor is preferred, including the indoaniline compounds described in U.S. Pat. No. 3,342,597; the Schiff base compounds described in U.S. Pat. No. 3,342,599, *Research Disclosure* 14, 850 and 15, 159; the aldol compounds described in *Research Disclosure* 13, 924; the metal salt complexes described in U.S. Pat. No. 3,719,492; and the urethane compounds described in JP-A-53-135628.

If necessary, for acceleration of color development, the silver halide color photosensitive material of the present invention may contain various 1-phenyl-3-pyrazolidones. Typical species of these compounds are mentioned in JP-A-56-64339, JP-A-57-144547 and JP-A-58-115438.

In the present invention, the processing baths are used at temperatures from 10° to 50° C. While the usual temperature range is 33° to 38° C., higher temperature can be used for accelerating the processes to reduce the processing times. Conversely, lower temperatures can be used to improve the picture quality or the stability of the processing baths. Furthermore, for reducing the amount of silver material, the cobalt intensification or hydrogen peroxide intensification described in West German Patent No. 2,226,770 or U.S. Pat. No. 3,674,499 can be conducted.

The method according to the present invention can be applied to the processing of color printing paper, color reversal paper, color direct positive paper.

The silver halide color photosensitive material to be used in accordance with the present invention is described in detail hereinafter.

The silver chloride content of the silver halide emulsion according to the present invention is not less than 80 mole percent, preferably not less than 95 mole percent and, for still better results, not less than 98 mole percent. From the standpoint of rapid processing, the silver chloride content is desirably as high as possible. Furthermore, the chloride-rich silver halide emulsion according to the present invention may contain minor amounts of silver bromide and silver iodide. This may be useful for improving sensitivity to light: it improves the amount of light absorption, increases the adsorption of spectral sensitizing dyes or attenuates the desensitization due to spectral sensitizing dyes. The preferred chloride-rich silver halide emulsion is such that silver chloride accounts for at least 80 mole percent of the total halide.

The silver halide grains to be used in accordance with the present invention may be of different phases for the core and the surface (core/shell grain), a polyphasic structure having junctions or a homogenous phase as a whole. These different structures may be present together.

The average grain size (the mean diameter when the grain is spherical or near-spherical; the root mean square of the projected area in the case of cubic grains; or the sphere equivalent in the case of tabular grains) of silver halide in the present invention is preferably in the range of 2 μm to 0.1 μm and more size distribution may be broad or narrow, but it is preferred for purposes of the present invention to employ a monodisperse silver halide emulsion such that the value (variation factor) found by dividing the standard deviation of the grain size distribution curve of the emulsion by the average grain size is not more than 20 percent and, preferably, not more than 15 percent. Furthermore, in order to provide suitable gradation for the photosensitive material, two or more kinds of monodisperse silver halide emulsions of different grain sizes (all of which preferably have variation factors within the above-mentioned range) can be coated in admixture in the same layer or successively in different layers of substantially identical color sensitivity. Furthermore, it is possible to use two or more different polydisperse silver halide emulsions or monodisperse and polydisperse emulsions in combination, either as a mixture or in successive layers.

The morphology of the silver halide to be used in the present invention may be regular, for example cubic, octahedral, rhombic, dodecahedral and/or tetradecahedral; or irregular, for example spherical. It may be a composite of such regular and irregular forms. Tabular grains can also be used. Particularly, an emulsion in which tabular grains with an aspect ratio (length/thickness) of not less than 5 and particularly not less than 8 provide at least 50 percent of the total projected area of the grains can be employed. It is also possible to use an emulsion containing a mixture of such varied crystal forms. Moreover, such emulsions may be of the surface latent image type (i.e., the latent image is formed predominantly on the surface), or of the internal latent image type (i.e., the latent image is formed in the core of the grain).

The coating amount of the silver halide emulsion in the present invention is not more than 1.5 g/m$^2$ as silver and preferably in the range of 0.8 g/m$^2$ to 0.3 g/m$^2$ on the same basis. The use of a coating amount not exceeding 0.8 g/m$^2$ is very advantageous for rapid development and subsequent removal of silver and for cutting down on the residual amount of silver.

The photographic emulsion used in the present invention can be prepared by the methods described in *Research Disclosure* Vol. 176, Item No. 17643, (I, II, III) (December 1978).

The emulsion used in the invention is generally subjected to physical ripening, chemical ripening and spectral sensitization. The additives to be used in such processes are described in *Research Disclosure* Vol. 176, No. 17643 (December 1978) and Vol. 187, No. 18716 (November 1979) and the relevant parts are summarized in the table below.

The known photographic additives which can be used in the invention are also described in the above two issues of *Research Disclosure,* as summarized below:

| | Additives | RD 17643 | RD 18716 |
|---|---|---|---|
| 1. | Chemical sensitizers | Page 23 | Page 648, right column |
| 2. | Sensitivity enhancer | | Page 648, right column |
| 3. | Spectral sensitizer Color sensitizer | Pages 23 to 24 | Page 648, right column to page 649, right column |
| 4. | Optical brightener | Page 24 | |
| 5. | Antifoggant stabilizer | Pages 24 to 25 | Page 649, right column |
| 6. | Light-absorber Filter dyes UV absorber | Pages 25 to 26 | Page 649, right column to page 650, left column |
| 7. | Stain inhibitor | Page 25, right column | Page 650, left to right columns |
| 8. | Dye image stabilizer | Page 25 | |
| 9. | Hardener | Page 26 | Page 651, left column |
| 10. | Binder | Page 26 | Page 651, left column |
| 11. | Plasticizer Lubricant | Page 27 | Page 650, right column |
| 12. | Coating auxiliaries Surfactants | Pages 26 to 27 | Page 650, right column |
| 13. | Antistatic agent | Page 27 | Page 650, right column |

In the materials processed according to the present invention, various color couplers can be employed. Specific examples of such color couplers can be found in the patents mentioned in *Research Disclosure* No. 17643, VII-C to G.

Preferred yellow couplers are those described, for example, in U.S. Pat. Nos. 3,933,501, 4,022,620, 4,326,024, and 4,401,752, JP-B-No. 58-10739 and British Patent Nos. 1,425,020 and 1,476,760.

Preferred magenta couplers include 5-pyrazolone and pyrazole compounds and the specific compounds described in U.S. Pat. Nos. 4,310,619 and 4,351,897, European Pat. No. 73,639, U.S. Pat. Nos. 3,061,432 and 3,725,067, *Research Disclosure* No. 24220 (June, 1984), JP-A-60-33552, *Research Disclosure* No. 24230 (June, 1984), JP-A-60-43659, and U.S. Pat. Nos. 4,500,630 and 4,540,654 are particularly useful.

Cyan couplers include phenol and naphthol couplers and are preferably those mentioned in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,720, European Pat. No. 121,365A, U.S. Pat. Nos. 3,446,622, 4,333,999, 4,451,559 and 4,427,767, and European Pat. No. 161,626A.

Colored couplers for correcting unwanted absorptions of developed dyes are preferably those 1 mentioned in *Research Disclosure* No. 17643, VII-G, U.S. Pat. No. 4,163,670, JP-B-57-39413, U.S. Pat. Nos. 4,004,929 and 4,138,258, and British Patent No. 1,146,368.

Preferred couplers assuring the proper diffusibility of developed dyes are described in U.S. Pat. No. 4,366,237, British Patent No. 2,125,570, European Pat. No. 96,570, and West German Patent Application (OLS) No. 3,234,533.

Typical examples of dye-forming polymer couplers are mentioned in U.S. Pat. Nos. 3,451,820, 4,080,211 and 4,367,282 and British Patent No. 2,102,173.

Those couplers which release photographically useful residues by a coupling reaction can also be used with advantage in the practice of the present invention. Preferred examples of the DIR couplers which release development inhibitors are disclosed in the patents cited in *Research Disclosure* No. 17643, VII-F, referred to above including. JP-A-57151944, JP-A-57-154234 and JP-A-60-184248, and U.S. Pat. 4,248,962.

Preferred examples of the couplers which release nucleating agents or development accelerators imagewise in development are mentioned in British Pat. Nos. 2,131,188, and JP-A-59-157638, JP-A-59-170840.

Other couplers which can be incorporated in the photosensitive material of the invention include the competitive couplers mentioned in U.S. Pat. No. 4,130,427, polyequivalent couplers mentioned in U.S. Pat. Nos. 4,283,472, 4,338,393 and 4,310,618, DIR redox compound-releasing couplers described in JP-A-60-185950 and couplers adapted to release dyes which regain colors after cleavage described in European Pat. No. 173,302A.

These couplers can be incorporated in the photosensitive material of the invention by various known dispersing methods.

Examples of high-boiling solvents to be used in the oil-in-water dispersion process are given in U.S. Pat. No. 2,322,027.

The procedure and effects of the latex dispersion process, and examples of latices are described in U.S. Pat. No. 4,199,363, and West German Patent Application (OLS) Nos. 2,541,274 and 2,541,230.

The bases which can be appropriately used for purposes of the invention are described, for example, in *Research Disclosure* No. 17643 at page 68 and No. 18716 at page 647, R column to page 648, L column.

In the present invention, the following compounds are preferably used in combination with the above-mentioned couplers. Particularly, their use with pyrazoloazole couplers is desirable.

Thus, the concurrent or independent use of a compound (F) which will chemically bind the aromatic amine developing agent remaining after color development to form a chemically inert and substantially colorless compound and/or a compound (G) which will chemically bind the oxide of the aromatic amine developing agent remaining after color development to form a chemically inert and substantially colorless compound is desirable, for example, to inhibit staining and other secondary effects due to the production of color on reaction between the residual color developer after development and the coupler.

Preferred species of compound (F) are those compounds which react to p-anisidine with a second-order reaction rate constant $k_2$ (in trioctyl phosphate at 80° C.) in the range of 1.0 l/mol.sec to $1\times10^{-5}$ l/mol.sec. The second-order reaction rate constant can be determined by the method described in JP-A-No. 63-158545.

When $k_2$ is in excess of the above range, the compound itself is labile and may react with gelatin and water and become decomposed. On the other hand, when $k_2$ is smaller than the above-mentioned range, the compound is so slow to react with the residual aromatic amine developing agent that it will not inhibit the secondary effects of the residual aromatic amine developing agent and thereby frustrate the object of the invention.

Preferred species of compound (F) are represented by formula (FI) or (FII).

$$R_1-(A)_n-X \qquad \text{(FI)}$$

$$R_2-\underset{\underset{B}{|}}{C}=Y \qquad \text{(FII)}$$

wherein $R^1$ and $R^2$, which may be the same or different, each represents an aliphatic group, an aromatic group or a heterocyclic group; n is 1 or 0; A represents a group which forms a chemical bond upon reaction of the compound with an aromatic amine developing agent; X represents a group which leaves upon reaction of the compound with an aromatic amine developing agent; B represents hydrogen, an aliphatic group, an aromatic group, a heterocyclic group, an acyl group or a sulfonyl group; and Y represents a group which accelerates the addition of an aromatic amine developing agent to the compound of formula (FII); provided that $R_1$ and X, or Y and $R_2$ or B, may be linked to form a cyclic structure.

The principal modes of chemical bonding with the residual aromatic amine developing agent are substitution and addition reactions.

Preferred examples of the compounds (FI) and (FII) are described in JP-A-63-158545 and JP-A-62-283338, and Japanese Patent Application Nos. 62-158342 and 63-18439.

Preferred examples of compound (G) which will chemically bind the oxide of the aromatic amine developing agent remaining after color development to form a chemically inert and substantially colorless compound are represented by formula (GI):

$$R-Z \qquad \text{(GI)}$$

wherein R represents an aliphatic group, an aromatic group or a heterocyclic group; Z is a nucleophilic group or a group which is decomposed in the photosensitive material after development to release a nucleophilic group. Preferred compounds (GI) are those in which Z is a group with a Pearson nucleophilicity $n_{CH_3I}$ value (R. G. Pearson, et al., J. Am. Chem. Soc. 90, 319, 1968) of at least 5 or a group derived from such a group.

Preferred examples of compound (GI) are given in European Published Patent Application Nos. 255722, JP-A-62-143048 and JP-A-62-229145, and Japanese Patent Application No. 63-18439, 63-136724, 62-214681 and 62-158342.

Detailed in formation on combinations of the above compounds (G) and (F) can be found in Japanese Patent Application No. 63-18439.

Suitable bases or supports which can be used in the present invention are described, for example, in *Research Disclosure* No. 17643 at page 28 and No. 18716 at page 647, R column to page 648, L column.

The present invention is now described in greater detail with reference to the following specific examples, but the present invention is not to be construed as being limited thereto. Unless otherwise

EXAMPLE 1

Using a paper base laminated with polyethylene on both sides, the following multi-layer color printing paper was prepared. The coating compositions were prepared in the following manner.

First layer coating solution

To a mixture of 19.1 g of yellow coupler ExY, 4.4 g of color image stabilizer Cpd-1 and 0.7 g of color image stabilizer Cpd-7 were added 27.2 cc of ethyl acetate and 8.2 g of solvent Solv-3 and the resulting solution was dispersed and emulsified in 185 cc of a 10% aqueous gelatin solution containing 8 cc of 10% sodium dodecylbenzenesulfonate. Separately, to a silver chlorobromide emulsion (average cubic grain size 0.88 μm, grain size distribution variation factor 0.08, grain surface silver bromide content 0.2% mole) were added $2.0\times10^{-}$moles each of the blue-sensitive sensitizing dyes described below per mole of Ag, and the mixture was subjected to sulfur sensitization. This emulsion was mixed with the above emulsified dispersion to give a first layer coating solution of described below. The second layer to 7th layer coating solutions were also prepared in a similar manner. As the gelatin hardener for each layer, 1-oxy-3,5-dichloro-s-triazine sodium salt was used.

The spectral sensitizing dyes used in the respective layers are shown below.

Blue-sensitive emulsion layer:

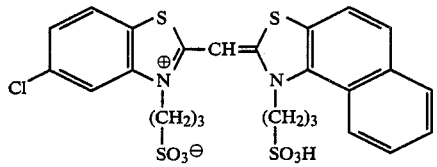

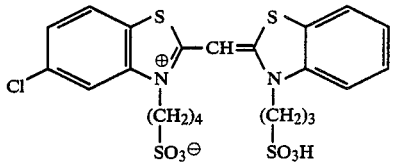

($2.0 \times 10^{-4}$ moles each per mole of silver halide)

Green-sensitive emulsion layer:

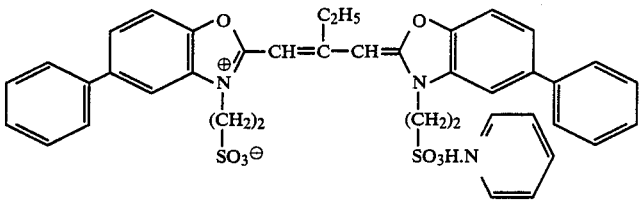

($4.0 \times 10^{-4}$ moles per mole of silver halide)

and

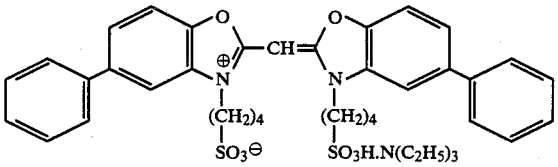

($7.0 \times 10^{-5}$ moles per mole of silver halide)

Red sensitive emulsion layer:

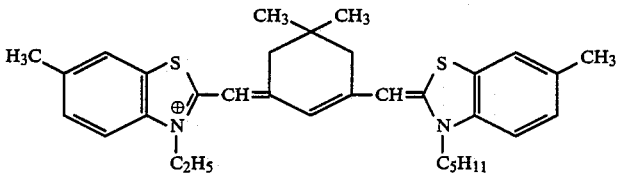

(0.9 × $10^{-4}$ moles per mole of silver halide)

To the red-sensitive emulsion layer, the following compound was added in a ratio of $2.6\times10^{-3}$ moles per mole of silver halide.

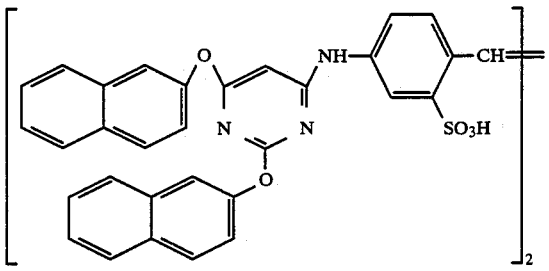

-continued

To the blue-, green- and red-sensitive emulsion layers, 1-(5-methylureidophenyl)-5-mercaptotetrazole was added in ratios of $8.5\times10^{-5}$ moles, $7.7\times10^{-4}$ moles and $2.5\times10^{-4}$ moles, respectively, each per ratio of silver halide.

For prevention of irradiation, the following dyes were added to the emulsion layers.

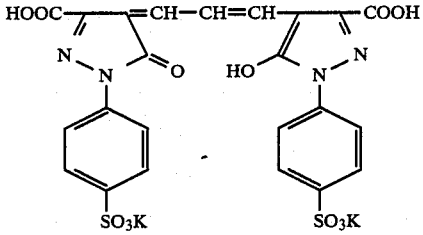

and

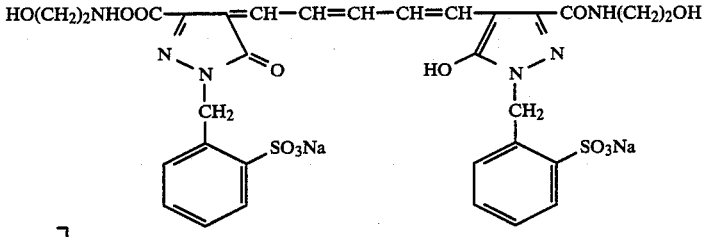

Layer construction

The composition of each layer is shown below. The figures represent coating amounts (g/m²). The figures for silver halide emulsions represents the coating amounts as silver.

| | |
|---|---|
| Base sheet | |
| Polyethylene laminated paper [containing a white pigment ($TiO_2$) and a blue dye (ultramarine) in the polyethylene film on the first layer side] | |
| First layer (blue-sensitive layer) | |
| Silver chlorobromide emulsion | 0.30 |
| Gelatin | 1.86 |
| Yellow coupler (ExY) | 0.82 |
| Color image stabilizer (Cpd-1) | 1.19 |
| Solvent (Solv-3) | 0.35 |
| Color image stabilizer (Cpd-7) | 0.06 |
| Second layer (Color mixing inhibition layer) | |
| Gelatin | 0.99 |
| Color mixing inhibitor (Cpd-5) | 0.08 |
| Solvent (Solv-1) | 0.16 |
| Solvent (Solv-4) | 0.08 |
| Third layer (Green-sensitive layer) | |
| Silver chlorobromide emulsion [a 1:3 | 0.12 |

-continued

| | |
|---|---|
| (mol Ag) mixture of grains with an average cubic grain size of 0.55 μm and 0.39 μm; grain size distribution variation factors: 0.10 and 0.08, respectively; grain surface AgBr content 0.8 mol %) | |
| Gelatin | 1.24 |
| Magenta coupler (ExM) | 0.27 |
| Color image stabilizer (Cpd-3) | 0.15 |
| Color image stabilizer (Cpd-8) | 0.02 |
| Color image stabilizer (Cpd-9) | 0.03 |
| Solvent (Solv-2) | 0.54 |
| Fourth layer (Ultraviolet absorption layer) | |
| Gelatin | 1.58 |
| Ultraviolet absorber (UV-1) | 0.47 |
| Color mixing inhibitor (Cpd-5) | 0.05 |
| Solvent (Solv-5) | 0.24 |
| Fifth layer (Red-sensitive layer) | |
| Silver chlorobromide emulsion [a 1:4 (mol Ag) mixture of grains with an average cubic grain size of 0.58 μm and 0.45 μm; grain size distribution variation factors: 0.09 and 0.11, respectively; grain surface AgBr content 0.6 mol %) | 0.23 |
| Gelatin | 1.34 |
| Cyan coupler (ExC) | 0.32 |
| Color image stabilizer (Cpd-6) | 0.17 |
| Color image stabilizer (Cpd-10) | 0.04 |
| Color image stabilizer (Cpd-7) | 0.40 |
| Solvent (Solv-6) | 0.15 |
| Sixth layer (Ultraviolet absorption layer) | |
| Gelatin | 0.53 |
| Ultraviolet absorber (UV-1) | 0.16 |
| Color mixing inhibitor (Cpd-5) | 0.02 |
| Solvent (Solv-5) | 0.08 |
| Seventh layer (Protective layer) | |
| Gelatin | 1.33 |
| Acryl-modified polyvinyl alcohol (degree of modification 17%) | 0.17 |
| Liquid paraffin | 0.03 |

(ExY) Yellow coupler

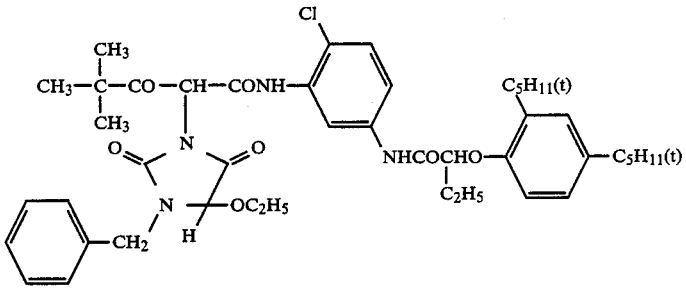

(ExM) Magenta coupler

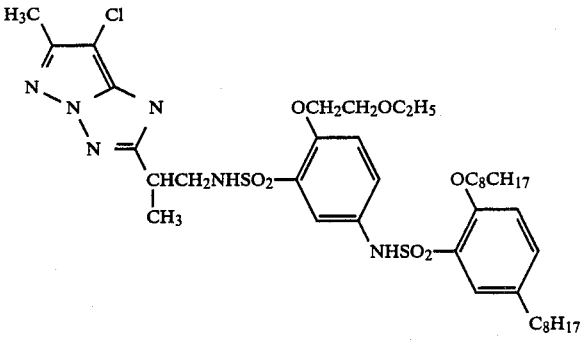

-continued (ExC) Cyan coupler

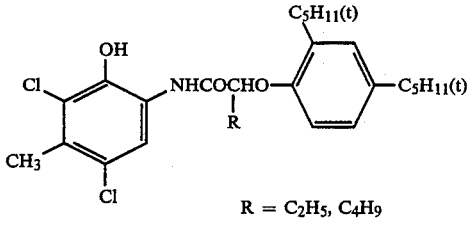

(A)

and

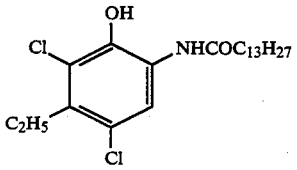

(C)

A 2:4:4 (by weight) mixture of the above compounds (A) where R is $C_2H_5$ ; (A) where R is $C_4H_9$ ; (C)

(Cpd-1) Color image stabilizer

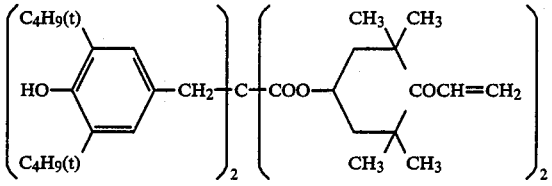

(Cpd-3) Color image stabilizer

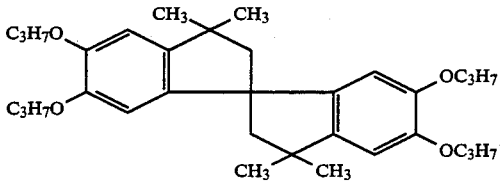

(Cpd-4) Color Image stabilizer

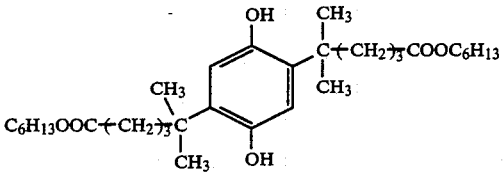

(Cpd-5) Color mixing inhibitor

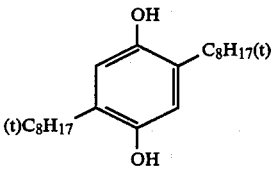

-continued (Cpd-6) Color image stabilizer

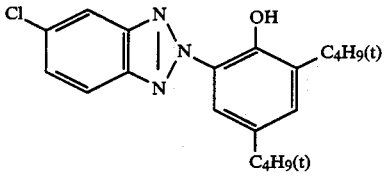

(D)

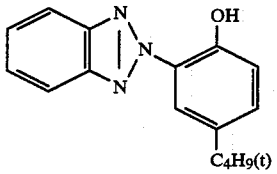

(E)

and

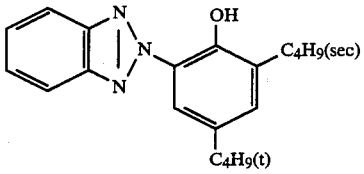

(F)

A 2:4:4 (by weight) mixture of the above compounds (D):(E):(F)

(Cpd-7) Color image stabilizer

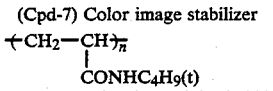

Average molecular weight 60,000

(Cpd-8) Color image stabilizer

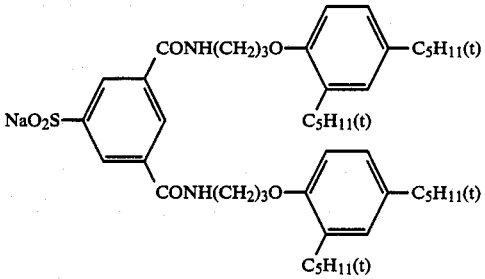

-continued (Cpd-9) Color image stabilizer

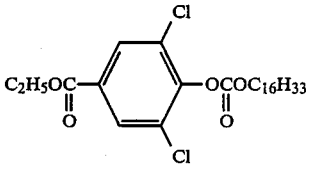

(Cpd-10) Color image stabilizer

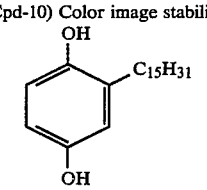

(UV-1) Ultraviolet absorber

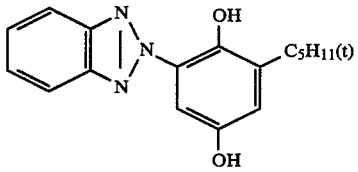

(G)

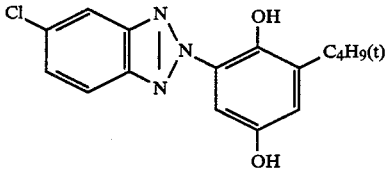

(H)

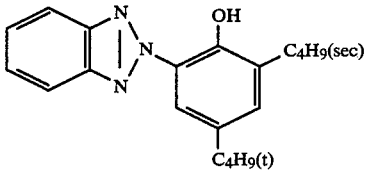

(J)

A 4:2:4 (by weight) mixture of the above compounds (G):(H):(J)

(Solv-1) Solvent

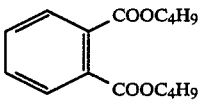

(Solv-2) Solvent

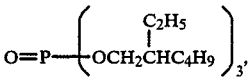

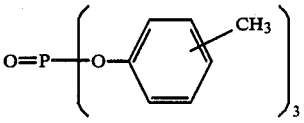

A 2:1 (by weight) mixture of the above compounds (Solv-3) Solvent $O{=}P{+}O{-}C_9H_{19}(iso))_3$ (Solv-4) Solvent

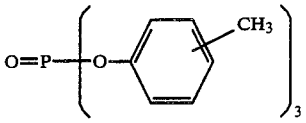

(Solv-5) Solvent

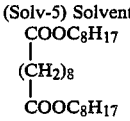

(Solv-6) Solvent

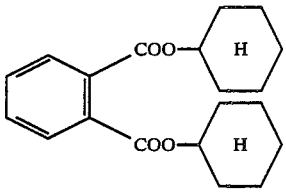

The imgewise-exposed photosensitive material was continuously processed (running test) using the following processes and processing bath compositions until the amount of replenishment reached twice the color developer tank capacity. However, the composition of the color developer was varied as shown in Table 1 and the running test was carried out under each condition.

| Process | Temperature (°C.) | Time | Replenishment (ml) (*1) | Tank capacity (*) | Bath opening ratio ($cm^{-1}$) (*2) |
|---|---|---|---|---|---|
| Color development | 35 | 45 sec. | 80 | 12 l | See Table 1 |
| Bleach-fix | 35 | 45 sec. | 160 | 12 l | 0.01 |
| Wash (1) | 35 | 20 sec. | — | 10 l | 0.01 |
| Wash (2) | 35 | 20 sec. | — | 10 l | 0.01 |
| Wash (3) | 35 | 20 sec. | — | 10 l | 0.01 |
| Water (4) | 35 | 30 sec. | 248 | 10 l | 0.01 |
| Drying | 80 | 60 sec. | — | — | — |

(Four-tank counter-current system(4) → (1))
(*1) The volume per $m^2$ of the photosensitive material
(*2) The bath opening ratio was varied by adjusting the depth of the processing tank.

| Color developer | Bath | Relenisher |
|---|---|---|
| Water | 800 ml | 800 ml |
| Ethylenediamine N,N,N',N'-tetramethylenephosphonic acid | 3.0 g | 3.9 g |
| Sodium chloride | See Table 1 | See Table 1 |
| Potassium carbonate | 30 g | 30 g |
| Fluorescent brightener (4B, Sumitomo Chemical) | 1.6 g | 2.9 g |
| Potassium bromide | 0.02 g | 0 g |
| Preservative (See Table 1) | 47 mmol | 72 mmol |
| Triethanolamine | 8.0 g | 10 g |
| 3-Methyl-4-amino-N-ethyl-N-(β-methanesulfonamidoethyl)-aniline sulfate | 5.4 g | 8.5 g |
| Water to make | 1000 ml | 1000 ml |
| pH (25° C.) | 10.10 | 10.59 |
| Bleach-fix (same for bath and replenisher) | | |
| EDTAFe (III) $NH_4.2H_2O$ | | 60 g |
| $EDTA.2Na.2H_2O$ | | 4 g |
| Sodium thiosulfate (70%) | | 120 ml |

-continued

| | |
|---|---|
| Sodium sulfite | 16 g |
| Glacial acetic acid | 7 g |
| Water to make | 1000 ml |
| pH (25° C.) | 5.5 |
| Washing Water (same for bath and replenisher) | |
| Deionized water (Ca and Mg, not more than 3 ppm each) | |

The above color paper was exposed through a wedge and subjected to a running test.

After each running test, the photographic characteristics were evaluated. Thus, changes in yellow, magenta and cyan sensitivities (ΔS) and changes in gradation (Δγ) were determined. The sensitivity was expressed in LogE values at a point higher by 0.2 than the minimum density and the gradation was expressed as the change from the density point of 0.5 to the density point higher by logE 0.3. The results are shown in Table 1. It is apparent from Table 1 that when sodium chloride was outside of the concentration range defined in the invention (Nos. 1 to 6), reducing the bath opening ratio to less than 0.05 $cm^{-1}$ resulted in somewhat reduced changes in photographic characteristics but the result was not fully satisfactory. On the other hand, even when the concentration of sodium chloride was within the range defined in the invention, changes in photographic characteristics could not be sufficiently controlled at large bath opening ratios (Nos. 7 to 12). However, in accordance with the present invention, changes in photographic characteristics were remarkably decreased (Nos. 13 to 29).

The superiority of the present invention is particularly apparent from the following comparisons: Nos. 9 and 10 vs. No. 14: Nos. 11 and 12 vs. No. 15: and Nos. 7 and 8 vs. No. 13.

TABLE 1

| Experiment No. | Sodium chloride* [g/l] (mol/l) Tank | Sodium chloride* [g/l] (mol/l) Replenisher | Bath opening ratio ($cm^{-1}$) | Preservative | Change in sensitivity (ΔS) Yellow | Change in sensitivity (ΔS) Magenta | Change in sensitivity (ΔS) Cyan | Change in gradation (ΔY) Yellow | Change in gradation (ΔY) Magenta | Change in gradation (ΔY) Cyan | Remarks |
|---|---|---|---|---|---|---|---|---|---|---|---|
| 1 | 12.0 ($2.05 \times 10^{-1}$) | 8.3 ($1.4 \times 10^{-1}$) | 0.06 | I-7 | −0.11 | −0.09 | −0.10 | +0.05 | +0.04 | +0.03 | Comparative Example |
| 2 | 12.0 ($2.05 \times 10^{-1}$) | 8.3 ($1.4 \times 10^{-1}$) | 0.03 | " | −0.10 | −0.08 | −0.09 | +0.04 | +0.03 | +0.03 | Comparative Example |
| 3 | 12.0 ($2.05 \times 10^{-1}$) | 8.3 ($1.4 \times 10^{-1}$) | 0.01 | " | −0.08 | −0.07 | −0.08 | +0.03 | +0.03 | +0.02 | Comparative Example |
| 4 | 1.0 ($1.7 \times 10^{-2}$) | 0 | 0.06 | " | −0.12 | −0.08 | −0.09 | +0.04 | +0.04 | +0.03 | Comparative Example |
| 5 | 1.0 ($1.7 \times 10^{-2}$) | " | 0.03 | " | −0.12 | −0.08 | −0.08 | +0.04 | +0.03 | +0.03 | Comparative Example |
| 6 | 1.0 ($1.7 \times 10^{-2}$) | " | 0.01 | " | −0.09 | −0.07 | −0.07 | +0.03 | +0.03 | +0.02 | Comparative Example |
| 7 | 3.5 ($6.0 \times 10^{-2}$) | 0.9 ($1.5 \times 10^{-2}$) | 0.06 | " | −0.11 | −0.08 | −0.07 | +0.04 | +0.03 | +0.03 | Comparative Example |
| 8 | 3.5 ($6.0 \times 10^{-2}$) | 0.9 ($1.5 \times 10^{-2}$) | 0.03 | " | −0.08 | −0.06 | −0.05 | +0.03 | +0.02 | +0.03 | Comparative Example |
| 9 | 3.5 ($6.0 \times 10^{-2}$) | 0.9 ($1.5 \times 10^{-2}$) | 0.06 | Hydroxylamine | −0.09 | −0.09 | −0.08 | +0.14 | +0.11 | +0.10 | Comparative Example |
| 10 | 3.5 ($6.0 \times 10^{-2}$) | 0.9 ($1.5 \times 10^{-2}$) | 0.03 | Hydroxylamine | −0.09 | −0.08 | −0.07 | +0.13 | +0.10 | +0.10 | Comparative Example |
| 11 | 3.5 ($6.0 \times 10^{-2}$) | 0.9 ($1.5 \times 10^{-2}$) | 0.06 | N,N-Diethylhydroxylamine | −0.09 | −0.08 | −0.08 | +0.13 | +0.09 | +0.09 | Comparative Example |
| 12 | 3.5 ($6.0 \times 10^{-2}$) | 0.9 ($1.5 \times 10^{-2}$) | 0.03 | N,N-Diethylhydroxylamine | −0.07 | −0.07 | −0.06 | +0.12 | +0.07 | +0.07 | Comparative Example |
| 13 | 3.5 ($6.0 \times 10^{-2}$) | 0.9 ($1.5 \times 10^{-2}$) | 0.01 | I-7 | −0.02 | −0.01 | −0.01 | ±0 | ±0 | ±0 | This Invention |
| 14 | 3.5 ($6.0 \times 10^{-2}$) | 0.9 ($1.5 \times 10^{-2}$) | 0.01 | Hydroxylamine | −0.04 | −0.03 | −0.03 | +0.04 | +0.03 | +0.03 | This Invention |
| 15 | 3.5 ($6.0 \times 10^{-2}$) | 0.9 ($1.5 \times 10^{-2}$) | " | N,N-Diethylhydroxylamine | −0.03 | −0.02 | −0.03 | +0.03 | +0.03 | +0.03 | This Invention |
| 16 | 3.5 ($6.0 \times 10^{-2}$) | 0.9 ($1.5 \times 10^{-2}$) | 0.005 | I-7 | −0.01 | ±0 | −0.01 | ±0 | ±0 | ±0 | This Invention |
| 17 | 3.5 ($6.0 \times 10^{-2}$) | 0.9 ($1.5 \times 10^{-2}$) | 0.002 | " | ±0 | ±0 | ±0 | ±0 | ±0 | ±0 | This Invention |
| 18 | 3.5 ($6.0 \times 10^{-2}$) | 1.35 ($2.3 \times 10^{-2}$) | 0.01 | I-8 | −0.02 | −0.01 | −0.01 | +0.01 | +0.01 | ±0 | This Invention |
| 19 | 3.5 ($6.0 \times 10^{-2}$) | 1.35 ($2.3 \times 10^{-2}$) | " | I-12 | −0.01 | −0.01 | ±0 | +0.01 | +0.01 | +0.01 | This Invention |
| 20 | 3.5 ($6.0 \times 10^{-2}$) | 1.35 ($2.3 \times 10^{-2}$) | " | I-13 | −0.01 | ±0 | −0.01 | ±0 | ±0 | +0.01 | This Invention |
| 21 | 3.5 ($6.0 \times 10^{-2}$) | 1.35 ($2.3 \times 10^{-2}$) | " | I-16 | −0.02 | −0.01 | −0.01 | ±0 | ±0 | −0.01 | This Invention |
| 22 | 3.5 ($6.0 \times 10^{-2}$) | 1.35 ($2.3 \times 10^{-2}$) | " | I-17 | −0.01 | ±0 | ±0 | +0.01 | ±0 | +0.01 | This Invention |
| 23 | 3.5 ($6.0 \times 10^{-2}$) | 1.35 ($2.3 \times 10^{-2}$) | " | I-22 | ±0 | −0.01 | −0.01 | +0.01 | +0.01 | ±0 | This Invention |
| 24 | 3.5 ($6.0 \times 10^{-2}$) | 1.35 ($2.3 \times 10^{-2}$) | " | I-23 | −0.01 | −0.01 | ±0 | ±0 | ±0 | ±0 | This Invention |
| 25 | 3.5 ($6.0 \times 10^{-2}$) | 1.35 ($2.3 \times 10^{-2}$) | " | I-24 | −0.01 | −0.01 | −0.01 | ±0 | ±0 | +0.01 | This Invention |
| 26 | 3.5 ($6.0 \times 10^{-2}$) | 1.35 ($2.3 \times 10^{-2}$) | " | I-25 | ±0 | −0.01 | −0.01 | +0.01 | ±0 | +0.01 | This Invention |
| 27 | 3.5 | 1.35 | " | I-26 | −0.01 | ±0 | −0.01 | +0.01 | +0.01 | +0.01 | This |

TABLE 1-continued

| Experiment No. | Sodium chloride* [g/l] (mol/l) Tank | Replenisher | Bath opening ratio ($cm^{-1}$) | Preservative | Change in sensitivity (ΔS) Yellow | Magenta | Cyan | Change in gradation (ΔY) Yellow | Magenta | Cyan | Remarks |
|---|---|---|---|---|---|---|---|---|---|---|---|
| | $(6.0 \times 10^{-2})$ | $(2.3 \times 10^{-2})$ | | | | | | | | | Invention |

*In the column of "Sodium chloride", data in parentheses is in a unit of (mol/l).

EXAMPLE 2

The same running test as Example 1 was carried out except that the chloride ion concentration of the developer was set at 5.5 g/l for the bath and, as preservatives, I-44, I-49, I-51, I-58, I 80, I 81, I-82 and I-83 were respectively used at the bath opening ratio of 0.009 $cm^{-1}$, and the evaluation was made in the same manner as Example 1. The results were as satisfactory as those obtained in Example 1.

EXAMPLE 3

A multi-layer color paper was prepared by using a base paper laminated with polyethylene on both sides and the following layer coating compositions.

The coating solutions were prepared in the following manner.

FIRST LAYER COATING SOLUTION

In a mixture of 150 cc of ethyl acetate, 1.0 cc of solvent Solv-3 and 3.0 cc of solvent Solv-4 were dissolved 60.0 g of yellow coupler ExY and 28.0 g of fading inhibitor Cpd-1 and the solution was added to 450 cc of a 10% aqueous gelatin solution containing sodium dodecylbenzenesulfonate. The mixture was dispersed by means of a sonic homogenizer and the resulting dispersion was mixed with 420 g of a silver chlorobromide emulsion (silver bromide content 0.7 mole %) containing the blue sensitive sensitizing dye described below to prepare a first layer coating solution. Coating solutions for the second through seventh layers were also prepared in a similar manner. As the gelatin hardener for each coating solution, 1,2bis(vinylsulfonyl)ethane was used.

The spectral sensitizing dyes for the respective layers are shown below.

Blue-sensitive emulsion layer:

Anhydro-5-5'-chloro-3,3'-disulfoethylthiacyanine hydroxide

Green-sensitive emulsion layer:

Anhydro-9-ethyl ,5,5'-diphenyl-3,3'-disulfoethyloxacarbocyanine hydroxide

Red-sensitive emulsion layer:

3,3'-Diethyl-5-methoxy-9,9'-(2,2'-dimethyl-1,3-propano)thiacarbocyanine iodide.

The following compound was used as a stabilizer for each emulsion layer.

A 7:2:1 (mole ratio) mixture of 1-(2-acetamidophenyl)-5-mercaptotetrazole, 1-phenyl-5-mercaptotetrazole and 1-(p-methoxyphenyl)-5-mercaptotetrazole.

As irradiation inhibiting dyes, the following compounds were used.

[3-Carboxy-5-hydroxy-4-(3-(3-carboxy-5-oxo-1-(2,5-disulfonatophenyl)-2-pyrazolin-4-ylidene)-1propenyl)-1-pyrazolyl]benzene-2,5-disulfonate disodium salt N,N'-(4,8-Dihydroxy-9,10-dioxo-3,7 disulfonatoanthracene-1,5-diyl)bis(aminomethanesulfonate) tetrasodium salt

[3-Cyano 5-hydroxy-4-(3-(3-cyano-5-oxy-1-(4-sulfonatophenyl)-2-pyrazolin-4-ylidene)-1-pentanyl)-1pyrazolyl]benzene-4-sulfonate sodium salt

LAYER CONSTRUCTION

The composition of each layer is shown below. The figures represent coating amounts ($g/m^2$). The figures for silver halide emulsions represent the coating amounts as silver.

Base sheet

Paper laminated polyethylene on both sides

| | |
|---|---|
| First layer (blue-sensitive layer) | |
| Silver halide emulsion (AgBr: 0.7 mole %, cubic grain mean particle size 0.9 μm) | 0.29 |
| Gelatin | 1.80 |
| Yellow coupler (ExY) | 0.60 |
| Fading inhibitor (Cpd-1) | 0.28 |
| Solvent (Solv-3) | 0.01 |
| Solvent (Solv-4) | 0.03 |
| Second layer (color mixing inhibiting layer) | |
| Gelatin | 0.80 |
| Color mixing inhibitor (Cpd-2) | 0.055 |
| Solvent (Solv-1) | 0.03 |
| Solvent (Solv-2) | 0.016 |
| Third layer (green-sensitive layer) | |
| Silver halide emulsion (AgBr: 0.7 mole %, cubic grain mean particle size 0.45 μm) | 0.305 |
| Gelatin | 1.40 |
| Magenta coupler (ExM) | 0.67 |
| Fading inhibitor (Cpd-3) | 0.23 |
| Fading inhibitor (Cpd-4) | 0.11 |
| Solvent (Solv-1) | 0.20 |
| Solvent (Solv-2) | 0.02 |
| Fourth layer (color mixing inhibiting layer) | |
| Gelatin | 1.70 |
| Color mixing inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth layer (red-sensitive layer) | |
| Silver halide emulsion (AgBr: 4 mole %, cubic grain mean particle size 0.5 μm) | 0.21 |
| Gelatin | 1.80 |
| Cyan coupler (ExC-1) | 0.26 |
| Cyan coupler (ExC-2) | 0.12 |
| Fading inhibitor (Cpd-1) | 0.20 |
| Solvent (Solv-1) | 0.16 |
| Solvent (Solv-2) | 0.09 |
| Sixth layer (ultraviolet absorption layer) | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| Seventh layer (protective layer) | |
| Gelatin | 1.07 |

(ExY) Yellow coupler

α-Pivalyl-α-(3-benzyl-1-hydantoinyl)-2-chloro-5-[β-(dodecylsulfonyl)butylamido]acetoanilide (ExM) Magenta coupler 1-(2,4,6-Trichlorophenyl)-3-[2-chloro-5-(3-octadecenylsuccinimido)anilino]-5-pyrazolone
(ExC-1) Cyan coupler
2-Pentafluorobenzamido-4-chloro-5-[2-(2,4-ditert-amylphenoxy)-3-methylbutylamidophenol
(ExC-2) Cyan coupler
2,4-Dichloro-3-methyl-6-[α-(2,4-di-tert-amylphenoxy)-butylamido]phenol
(Cpd-1) Fading inhibitor
2,5-Di-tert-amylphenyl-3,5-di-tert-butylhydroxybenzoate
(Cpd-2) Fading inhibitor
2,5-di-tert-octylhydroquinone
(Cpd-3) Fading inhibitor
1,4-Di-tert-amyl-2,5-dioctyloxybenzene
(Cpd-4) Fading inhibitor
2,2'-Methylenebis(4-methyl-6-tert-butylphenol)
(Cpd-5) p0 p-(p-Toluenesulfonamido)phenyldodecan
(Solv-3) Solvent
Di-(i-nonyl)phthalate
(Solv-4) Solvent
N,N-Diethylcarbonamidomethoxy-2,4-di-t-amylbenzene
(UV-1) Ultraviolet absorber
2-(2-Hydroxy-3,5-di-tert-amylphenyl)benzotriazole
(UV-2) Ultraviolet absorber
2-(2-Hydroxy-3,5-di-tert-butylphenyl)benzotriazole
(Solv-1) Solvent
Di(2-ethylhexyl) phthalate
(Solv-2) Solvent
Dibutyl phthalate The above photosensitive material was processed as in Example 1 except that the chloride ion concentration of the developer was set at 4.0 g/l and the bath opening ratios and preservatives indicated in Table 2 were used, and the changes in yellow, magenta and cyan sensitivities and changes in gradation were investigated.

The results are shown in Table 2.

It is apparent from Table 2 that satisfactory results were obtained in accordance with this invention (Nos. 5 to 10).

TABLE 2

| Experiment No. | Sodium chloride* [g/l] (mol/l) Tank | Sodium chloride* [g/l] (mol/l) Replenisher | Bath opening ratio ($cm^{-1}$) | Preservative | Change in sensitivity (ΔS) Yellow | Magenta | Cyan | Change in gradation [ΔY] Yellow | Magenta | Cyan | Remarks |
|---|---|---|---|---|---|---|---|---|---|---|---|
| 1 | 4.0 ($6.8 \times 10^{-2}$) | 1.35 ($2.3 \times 10^{-2}$) | 0.06 | I-7 | −0.09 | −0.08 | −0.06 | +0.06 | +0.04 | +0.03 | Comparative Example |
| 2 | 4.0 ($6.8 \times 10^{-2}$) | 1.35 ($2.3 \times 10^{-2}$) | 0.03 | " | −0.07 | −0.07 | −0.05 | +0.04 | +0.03 | +0.03 | Comparative Example |
| 3 | 4.0 ($6.8 \times 10^{-2}$) | 1.35 ($2.3 \times 10^{-2}$) | 0.06 | Hydroxylamine | −0.10 | −0.09 | −0.07 | +0.16 | +0.12 | +0.11 | Comparative Example |
| 4 | 4.0 ($6.8 \times 10^{-2}$) | 1.35 ($2.3 \times 10^{-2}$) | 0.03 | Hydroxylamine | −0.09 | −0.06 | −0.04 | +0.11 | +0.09 | +0.09 | Comparative Example |
| 5 | 4.0 ($6.8 \times 10^{-2}$) | 1.35 ($2.3 \times 10^{-2}$) | 0.01 | Hydroxylamine | −0.03 | −0.02 | −0.01 | +0.05 | +0.04 | +0.04 | This Invention |
| 6 | 4.0 ($6.8 \times 10^{-2}$) | 1.35 ($2.3 \times 10^{-2}$) | " | I-7 | −0.01 | ±0 | ±0 | +0.01 | ±0 | ±0 | This Invention |
| 7 | 4.0 ($6.8 \times 10^{-2}$) | 1.35 ($2.3 \times 10^{-2}$) | " | I-27 | −0.01 | −0.01 | ±0 | +0.01 | ±0 | +0.01 | This Invention |
| 8 | 4.0 ($6.8 \times 10^{-2}$) | 1.35 ($2.3 \times 10^{-2}$) | " | I-29 | −0.01 | ±0 | ±0 | ±0 | ±0 | +0.01 | This Invention |
| 9 | 4.0 ($6.8 \times 10^{-2}$) | 1.35 ($2.3 \times 10^{-2}$) | " | I-32 | −0.01 | ±0 | −0.01 | +0.01 | +0.01 | +0.01 | This Invention |
| 10 | 4.0 ($6.8 \times 10^{-2}$) | 1.35 ($2.3 \times 10^{-2}$) | " | I-37 | −0.01 | ±0 | −0.01 | +0.01 | ±0 | +0.01 | This Invention |

*In the column of "Sodium chloride", data in parentheses is in a unit of (mol/l).

While the invention has been described in detail and with reference to specific embodiments thereof, it will be apparent to one skilled in the art that various changes and modifications can be made therein without departing from the spirit and scope thereof.

What is claimed is:

1. A method for continuous processing of a silver halide color photosensitive material which comprises developing a color photographic light-sensitive material comprising a support having thereon at least one light-sensitive silver halide emulsion layer containing a silver halide comprising at least 80 mol % silver chloride, concentration of from $3.5\times10^{-2}$ to $2.0\times10^{-1}$ mol/l, said developing step being conducted in a developer bath having a bath opening ratio (S/V) of at most 0.015 $cm^{-1}$ wherein S is the air-contacting area of the bath in $cm^2$ and V is the total volume of the bath in $cm^3$.

2. The method as claimed in claim 1, further comprising the step of replenishing said developer solution in continuous processing of a predetermined amount of said color photogaraphic light-sensitive material.

3. The method as claimed in claim 1, wherein the bath opening ratio (S/V) is not larger than 0.01.

4. The method as claimed in claim 1, wherein the bath opening ratio (S/V) is not smaller than 0.0005.

5. The method as claimed in claim 1, wherein said developer solution has a chloride ion concentration of from $4.0\times10^{-2}$ to $1.5\times10^{-1}$ mol/l.

6. The method as claimed in claim 1, wherein said developer solution comprises at least one compound represented by formula (I):

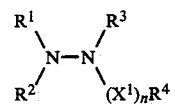

(I)

wherein $R^1$, $R^2$ and $R^3$ each represents hydrogen, an alkyl group, an aryl group or a heterocyclic group; $R^4$ represents hydrogen, a hydroxyl group, a hydrazino group, an alkyl group, an aryl group, a heterocyclic group, an alkoxy group, an aryloxy group, a carbamoyl group or an amino group; $X^1$ represents a divalent linking group; and n is 0 or 1; provided that when n is 0, $R^4$ represents an alkyl group, an aryl group or a heterocyclic group; and $R^3$ and $R^4$ may be linked to form a heterocyclic group.

7. The method as claimed in claim 6, wherein $X^1$ represents —CO—, —$SO_2$—or $$-\overset{\overset{\displaystyle NH}{\|}}{C}-;$$

n is 0; and at least one of $R^1$, $R^2$, $R^3$ and $R^4$ represents a substituted or unsubstituted alkyl group.

8. The method as claimed in claim 7, wherein at least one of $R^1$, $R^2$, $R^3$ and $R^4$ represents a substituted or unsubstituted alkyl group and the remainder each represents hydrogen or a substituted or unsubstituted alkyl group.

9. The method as claimed in claim 6, wherein said developer solution contains 0.1 to 50 g per liter of said compound represented by formula (I).

10. The method as claimed in claim 1, wherein said silver halide in said light-sensitive silver halide emulsion contains at least 95 mol % silver chloride.

11. The method as claimed in claim 10, wherein said silver halide in said light-sensitive silver halide emulsion contains at least 98 mol % silver chloride.

12. The method as claimed in claim 1, wherein said light-sensitive silver halide emulsion layer further comprises a pyrazolazole coupler; at least one compound represented by formula (FI) or (FII); and at least one compound represented by formula (GI):

$$R_1-(A)_n-X \qquad \text{(FI)}$$

$$R_2-\underset{\underset{\displaystyle B}{|}}{C}=Y \qquad \text{(FII)}$$

wherein $R^1$ and $R^2$ each represents an aliphatic group, an aromatic group or a heterocyclic group; n is 1 or 0; A represents a group capable of forming a chemical bond by reacting with an aromatic amine developing agent; X represents a group which is eliminated upon said reaction of A with said aromatic amine developing agent; B represents hydrogen, an aliphatic group, an aromatic group, a heterocyclic group, an acyl group or a sulfonyl group; and Y represents a group capable of accelerating the addition of said aromatic amine developing agent to $R^1$ and X, Y and $R_2$ or Y and B may be linked to form a cyclic structure; and $$R-Z \qquad \text{(GI)}$$

wherein R represents an aliphatic group, an aromatic group or a heterocyclic group; and Z represents a nucleophilic group or a group which is decomposed in said photosensitive material after development to release a nucleophilic group.

13. The method as claimed in claim 1, wherein said color developer solution comprises from 0.5 to 10 g/l of a p-phenylenediamine color developer.

* * * * *

UNITED STATES PATENT AND TRADEMARK OFFICE

CERTIFICATE OF CORRECTION

PATENT NO. : 4,965,175

DATED : October 23, 1990

INVENTOR(S) : Hiroshi Fujimoto; Kazuaki Yoshida

It is certified that error appears in the above-identified patent and that said Letters Patent is hereby corrected as shown below:

Column 34, line 10, after "ride," and before "concentration" insert --in a color developer solution containing a chloride ion--.

Column 36, line 18, after "agent to" insert --said compound represented by formula (FII), provided that--.

Signed and Sealed this

Twenty-second Day of September, 1992

*Attest:*

DOUGLAS B. COMER

*Attesting Officer*

*Acting Commissioner of Patents and Trademarks*